US006481395B2

(12) United States Patent
Kreitmann et al.

(10) Patent No.: US 6,481,395 B2
(45) Date of Patent: Nov. 19, 2002

(54) DEVICE FOR ACTUATING A GAS EXCHANGE VALVE

(75) Inventors: Fritz Kreitmann, Esslingen (DE); Hagen Müller, Stuttgart (DE); Alexander von Gaisberg, Fellbach (DE)

(73) Assignee: Daimler Chrysler A.G., Stuttgart (DE)

( * ) Notice: Subject to any disclaimer, the term of this patent is extended or adjusted under 35 U.S.C. 154(b) by 0 days.

(21) Appl. No.: 09/902,338

(22) Filed: Jul. 10, 2001

(65) Prior Publication Data

US 2002/0017254 A1 Feb. 14, 2002

Related U.S. Application Data

(63) Continuation-in-part of application No. PCT/EP00/00156, filed on Jan. 12, 2000.

(51) Int. Cl.[7] ..... F01L 9/04

(52) U.S. Cl. ..... 123/90.11; 123/90.56; 251/129.15

(58) Field of Search ..... 123/90.11, 90.45, 123/90.46, 90.48, 90.52, 90.55, 90.56, 90.57

(56) References Cited

U.S. PATENT DOCUMENTS 4,392,462 A * 7/1983 Lesher ..... 123/90.55
4,515,343 A * 5/1985 Pischinger et al. ..... 251/48
5,611,303 A * 3/1997 Izuo ..... 123/90.11
6,089,197 A * 7/2000 Lange et al. ..... 123/90.11

FOREIGN PATENT DOCUMENTS

| | | |
|---|---|---|
| DE | 41 09 666 | 9/1992 |
| DE | 197 23 785 | 12/1992 |
| JP | 08 284620 | 10/1996 |

* cited by examiner

*Primary Examiner*—Thomas Denion
*Assistant Examiner*—Ching Chang
(74) *Attorney, Agent, or Firm*—Klaus J. Bach

(57) ABSTRACT

In a device for actuating a gas exchange valve for internal combustion engines, having at least one compensating element which is arranged in the force path of an actuating element of the gas exchange valve and which has a pressure space which is formed by a piston and a working cylinder and is connected to a pressurized fluid supply space via a non-return valve and a throttling portion, via which pressure fluid can be discharged from the pressure space during the working cycles. The pressure space is sealed to the outside, and the compensating element includes a high-pressure valve, via which pressure medium can be discharged in a throttled manner during the working cycles of the gas exchange valve as the high-pressure valve opens at a predetermined force on the compensating element and closes at a predetermined force which is greater than an average force and smaller or equal to a maximum force on the compensating element.

9 Claims, 4 Drawing Sheets

DEVICE FOR ACTUATING A GAS EXCHANGE VALVE

This is a Continuation-In-Part application of International Application PCT/EPOO/00156 filed Jan. 12, 2000 and claiming the priorities of German patent applications 199 60 951.1 filed Jan. 13, 2000 and 199 56 136.2 filed Nov. 23, 1999.

BACKGROUND OF THE INVENTION

The invention relates to a device for actuating a gas exchange of an internal combustion engine including a hydraulic compensating structure.

Electromagnetic actuators for actuating the gas exchange valves generally have two operating magnets—one opening magnet and one closing magnet between whose pole faces an armature is arranged such that it can be displaced coaxially with the valve axis. The armature acts on a valve stem of the gas exchange valve either directly or via an armature tappet. In the case of actuators according to the principle of the mass oscillator, a prestressed spring mechanism acts on the armature. Usually, two prestressed valve springs, an upper valve spring of which biases the gas exchange valve in the opening direction and a lower valve spring of which biases the gas exchange valve in the closing direction, are used as the spring mechanism. When the magnets are not energized, the armature is held by the valve springs in a position of equilibrium between the two magnets. The valve springs can be arranged together on one side or separately from each other on opposite sides of the actuator.

When the actuator is first activated, either the closing magnet or the opening magnet is briefly overexcited or the armature is excited at its resonance frequency by an oscillation excitation routine, in order to move the armature out of the position of equilibrium. In the closed position of the gas exchange valve, the armature bears against the pole face of the energized closing magnet and is held by it. The closing magnet compresses further the valve spring, which acts in the opening direction. In order to open the gas exchange valve, the closing magnet is deenergized and the opening magnet is energized. The valve spring which acts in the opening direction then accelerates the armature beyond the position of equilibrium, with the result that the latter is attracted by the opening magnet. The armature impacts against the pole face of the opening magnet and is held firmly by the pole face. In order to close the gas exchange valve again, the opening magnet is deenergized and the closing magnet is energized. The valve spring which acts in the closing direction accelerates the armature beyond the position of equilibrium toward the closing magnet. The armature is attracted by the closing magnet, impacts on the pole face of the closing magnet and is held firmly by the latter. The two valve springs are compressed to such an extent that, when the operating magnets are deenergized, the armature moves to an approximately central position between the pole faces of the operating magnets, and that at the same time, in, or shortly before, the closing position of the gas exchange valve a residual closing force from the lower valve spring acts on the gas exchange valve.

Variables which have not been taken into consideration from the beginning or which change over time, for example manufacturing tolerances of individual components, thermal expansions of different materials, differing spring stiffnesses of the upper and lower valve springs on account of manufacturing tolerances, and also settling phenomena because of aging of the valve springs etc, may result in a position of equilibrium not coinciding with an energetic central position between the pole faces or not having a predetermined position, as this position is determined by the valve springs. Furthermore, variables of this type and wear on the valve seats may lead to the armature not bearing with a constant closing force against the pole face of the closing magnet or already bearing against it before the gas exchange valve is completely closed. Hot combustion gases, which escape past valves that are not tightly closed, destroy the valve seats. Also, different thermal expansions may cause the armature to no longer bear completely against the pole face of the closing magnet when the gas exchange valve is closed. As a result, the energy requirement of the closing magnet sharply increases. Furthermore, this process is generally associated with a reduced opening stroke of the gas exchange valve, with the result that the throttling losses increase during the charge cycle and the efficiency deteriorates.

If the gas exchange valves are actuated by a camshaft, thermal expansions, seat-ring deflection, settling phenomena because of aging of the valve springs etc. may likewise lead to the gas exchange valve not closing completely.

An earlier application DE 19 647 305 C1, illustrates an electromagnetic actuator which is mounted in a floating manner in a cylinder head. The said actuator opens and closes a gas exchange valve, while an armature is moved between two electromagnets and, in the process, acts on a valve stem of the gas exchange valve. A spring mechanism is arranged between the actuator and the valve disc of the gas exchange valve, with the upper opening spring being supported on the actuator and the lower closing spring on the cylinder head. A play-adjusting element which compensates for both a positive and a negative valve play is situated between a cover plate, which is connected to the cylinder head and the actuator on the side which faces away from the gas exchange valve.

The play-adjusting element has a piston in a cylinder. The piston separates a first pressure space, which faces away from the gas exchange valve and is controlled as a function of the internal combustion engine from a second pressure space, which faces the gas exchange valve. When there is excessive pressure in the first pressure space, a non-return valve in the piston opens in the direction of the second pressure space counter to the force of a holding spring. The holding spring is designed in such a manner that the non-return valve does not open if there is no play.

The gas exchange valve should always close securely. In order to achieve this, the play-adjusting element has the tendency to constantly slowly become shorter. This is achieved by a leakage area, which is formed by a defined play between the piston and the cylinder. When load is applied, pressure medium flows from the second pressure space into the first pressure space via the leakage area. If the armature no longer comes sufficiently close to the closing magnet or if a play arises between the armature tappet and the gas exchange valve because the play-adjusting element has become far too short, rapid adjustment in the opposite direction has to take place, which is achieved by the non-return valve opening. The pressure in the second pressure space drops below that of the first pressure space, so that the non-return valve opens towards the holding spring and pressure medium flows from the first pressure space into the second pressure space until the play has been compensated. This process may last for a number of working cycles of the valve.

The iterative process providing for rapid and slow adjustment has the effect that the gas exchange valve moves continuously within an optimum play-setting range. However, when the actuator is switched off, the armature is set by the valve springs to a position of equilibrium between the two magnets. In this case, a force of the valve springs acts on the second pressure space via the actuator. The pressure in the upper pressure space, which is controlled as a function of the internal combustion engine, drops and pressure medium is discharged from the second pressure space via the leakage area between the piston and the cylinder. The play-adjusting element collapses and the actuator is displaced upwards in the direction facing away from the gas exchange valve. As a result, the position of equilibrium of the valve springs is changed. After a renewed start of the actuator, the second pressure space of the play-adjusting element has to be filled, the actuator has to be displaced in the direction of the gas exchange valve and the position of equilibrium of the valve springs set to its correct value. This process may last for a number of working cycles of the gas exchange valve and may, in particular, lead to noises, unnecessary wear and to an additional expenditure of energy.

DE 41 09 666 A1 discloses a desmodromic control of a gas exchange valve, in which an opening cam and a closing cam act on a valve stem via a cup tappet. Two play-adjusting elements are arranged in the cup tappet, specifically an upper play-adjusting element, which faces away from the gas exchange valve and a lower play-adjusting element, which faces the gas exchange valve. Using a piston/cylinder unit, the upper play-adjusting element holds a bottom part of the cup tappet on the opening cam and, as it does so, is supported in the opening direction on the valve stem by the cylinder and in the closing direction on the bottom part by the piston. The second play-adjusting element uses a second piston/cylinder unit to hold a circumferential part of the cup tappet in contact with an arm, which is driven by the closing cam. The piston is designed as an annular piston, which is supported in the closing direction on the valve stem via a securing ring. It is guided displaceably in the circumferential part, which serves at the same time as the cylinder of the second play-adjusting element. The annular piston separates a lower pressure space, which is arranged on the sided which faces the gas exchange valve, from an upper supply space, which is arranged on the side, which faces away from the gas exchange valve. Furthermore, the second play-adjusting element has a non-return valve via which pressure medium can flow from the supply space to the pressure space via an aperture in the annular piston. The non-return valve closes the aperture with a valve ball, which is biased by a prestressed helical compression spring in the direction of the supply space. Two further helical compression springs, which are arranged in the pressure space, prestress the annular piston relative to the circumferential part.

In addition to the two play-adjusting elements, a pressure relief valve or a safety valve is arranged in the cup tappet. The safety valve is a non-return valve, which closes a second aperture in the annular piston by means of a valve ball, which is biased by a prestressed helical compression spring in the direction of the pressure space.

The helical compression spring is designed with regard to its prestressing force in such a manner that the safety valve remains closed in the case of forces which occur during normal valve actuation. However, should pumping up, i.e. a continuous expansion of the second play-adjusting element, take place during the valve operation because of resonant oscillations or an excessively high lubricating oil pressure, etc., the positive control via the closing cam would enable impermissibly high valve forces or pressures to occur which can be dissipated, in the case of the proposed design, by opening the pressure relief valve. The same applies whenever, during a prolonged standstill of the internal combustion engine, the first play-adjusting element has emptied, and during starting up, the second play-adjusting element expands ahead of the first play-adjusting element and impermissibly high valve forces would occur as a result.

The object of the invention is to provide a device for actuating gas exchange valves of an internal combustion engine having a compensating element which, by means of an iterative process providing for rapid and slow adjustment, is always within an optimum setting range, and the latter is achieved as rapidly as possible after startup of the internal combustion engine.

SUMMARY OF THE INVENTION

In a device for actuating a gas exchange valve for internal combustion engines, which device has at least one compensating element, that is arranged in the force path of an actuating element of the gas exchange valve and includes a pressure space, which is formed by a piston and a working cylinder and is connected to a pressurized fluid supply space via a non-return valve and a throttling structure via which pressure medium can be discharged from the pressure space during the working. cycles, the pressure space is sealed to the outside and the compensating element has a high-pressure valve, via which pressure medium is discharged, in a throttled manner, during the working cycles of the gas exchange valve as the high-pressure valve opens when a predetermined force acts on the compensating element and closes when another predetermined force which is greater than an average force and smaller than, or equal to, a maximum force acts on the compensating element.

With the gas exchange actuating device according to the invention, the compensating element maintains its setting when the internal combustion engine is at a standstill. This can be brought about by the compensating element being blocked mechanically, electrically or hydraulically when the internal combustion engine is shut down. One simple option is for the discharging of the pressurized fluid via the leakage area to be controllable by means of a valve. The valve can be a solenoid valve which, in the deenergized state, blocks the flow through the leakage area. The said valve can be activated as a function of suitable operating parameters of the internal combustion engine, so that discharging from the pressure space is possible only at certain time slots of the actuating cycle of the gas exchange valve. Otherwise, the effect is achieved by the compensating element being blocked hydraulically when the internal combustion engine is at a standstill, thereby maintaining its setting.

The valve can be arranged upstream or downstream of the leakage area, in the direction flow. If the leakage flow is provided by a leakage area between the piston and the cylinder, the valve is expediently arranged in a discharging or return line which, between the throttle gap and a sealing ring surrounding the piston, leads to the working cylinder.

A particular embodiment of the invention is based on the recognition that, in the case of devices for actuating gas exchange valves, the force acting on a compensating element during the working cycles fluctuates cyclically between a maximum and a minimum value, because of mass forces of inertia, pressure fluctuations in the cylinder head and, in particular in the case of devices which have at least one valve spring acting on the gas exchange valve, because of the change in the tension force over a working period. These fluctuations, which occur only during the working cycles, are used by the invention to achieve a defined leakage rate during the working cycles and to suppress the tendency for the compensating element to become slowly shorter or, in particular arrangements, to become longer when the internal combustion engine is at a standstill. During an engine shutdown, the compensating element therefore maintains its setting essentially unchanged.

Slow adjustment of a desired iterative process in one direction is preferably achieved by a high-pressure valve. During the working cycles, a certain amount of pressure medium is discharged, in a throttled manner, via the high-pressure valve as the latter open cyclically when a defined force is effective on the compensating element and closes upon occurrence of another predetermined force. The forces in each case are greater than an average force and smaller than, or equal to, a maximum force on the compensating element.

Rapid adjustment of the iterative process in the opposite direction is achieved by a non-return valve. If the internal combustion engine is shut down, cyclical fluctuations of the force on the compensating element do not occur. The defined opening force of the high-pressure valve in the region of a maximum force is not achieved or, in the case of certain devices, maintained only for a short period, for example in the case of a device having a valve spring which acts in the closing direction and in which the gas exchange valve remains in the open position. If, the force acting on the compensating element is smaller than the opening force, when the internal combustion engine is at a standstill, the high-pressure valve remains closed. No pressure medium is then discharged from the pressure space, which is tightly closed to the outside. As a result, the compensating element maintains its setting. If the acting force is greater than the opening force, only a small amount of pressure medium is discharged until the closing force is reached and the high-pressure valve is closed. The setting of the compensating element is then only slightly changed.

The solution according to the invention can be used in various types of devices for actuating a gas exchange valve, such as in the case of devices which have a valve opening cam and a valve closing cam and which do not have a valve spring. The invention concept may also be used in connection with devices having an opening cam and having a valve spring acting in the closing direction, etc. However, the solution according to the invention is used particularly advantageously in connection with electromagnetic gas exchange valve control mechanisms. Electromagnetic gas exchange valve control mechanisms have an actuator which has an opening magnet and a closing magnet with pole faces between which an armature is arranged in a manner such that it can be displaced coaxially and act on a valve stem of the gas exchange valve. Furthermore, a spring mechanism having at least one prestressed valve spring, which acts in the opening direction, and at least one prestressed valve spring which acts in the closing direction acts on the gas exchange valve. If the actuator is switched off by the internal combustion engine, the armature is set to a position of equilibrium of the valve springs between the pole faces of the magnets. In this position, the compensating element is acted upon by a force which is smaller than the opening force of the high-pressure valve and is greater than the opening force of the non-return valve, with the result that pressure medium is not discharged from the tightly closed pressure space and the setting of the compensating element is maintained when the internal combustion engine is shut down. The same effect can be obtained by the solenoid valve, which can be activated electrically.

The compensating element can be a play-adjusting element, a compensating element with which the prestress of a valve spring can be set or another compensating element which is arranged in the force transfer path of an actuating element to a gas exchange valve.

Further advantages will become apparent from the following description of an embodiment on the basis of the drawings.

DESCRIPTION OF PREFERRED EMBODIMENTS

Figure 1:
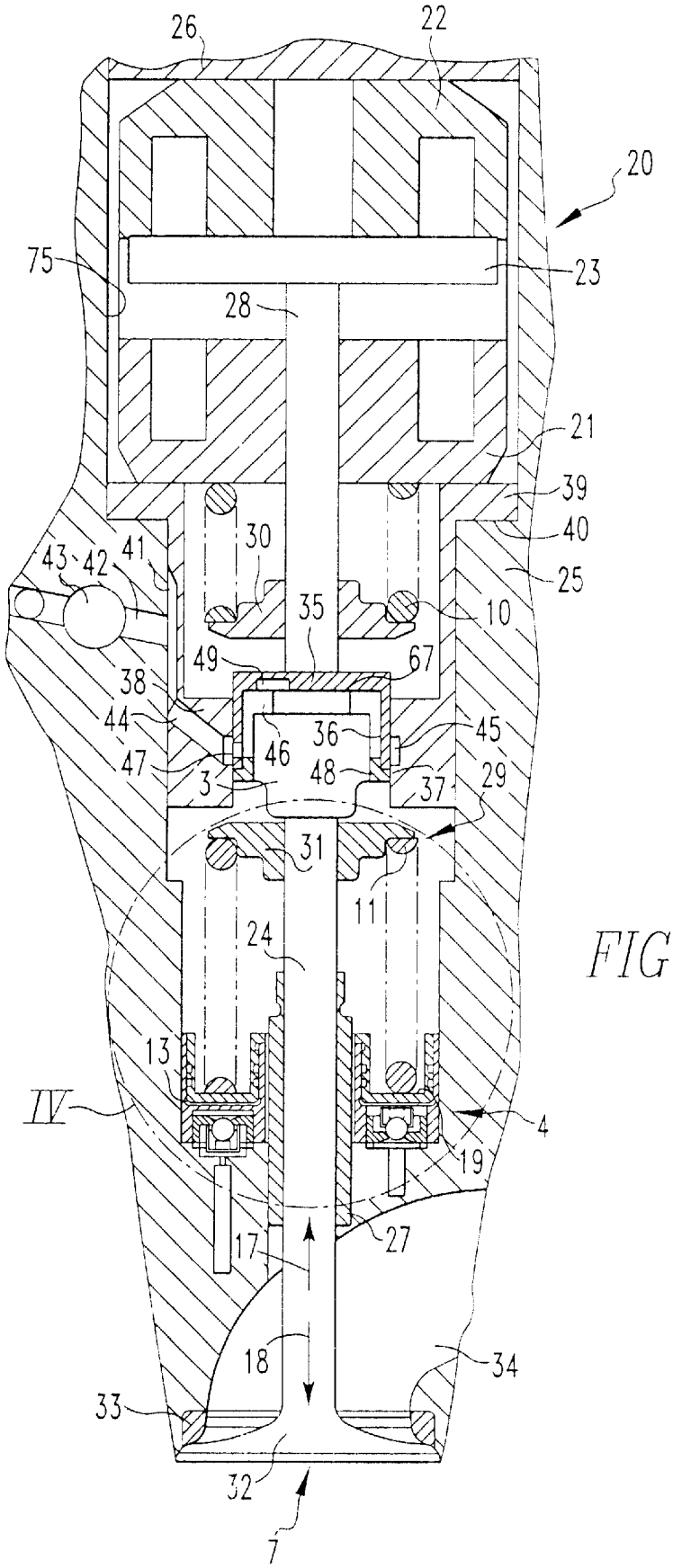
FIG. 1 Shows the device according to the invention in a schematic partial sectional view.

An electromagnetic actuator 20 is embedded in a recess 75 in a cylinder head 25, which recess is closed by a cylinder-head, cover 26 (not illustrated in further detail). The actuator 20 operates a gas exchange valve 7, which is guided by its valve stem 24 in the cylinder head 25 by means of a valve-stem guide 27. The actuator 20 has two operating magnets, specifically an upper closing magnet 22 and a lower opening magnet 21. An armature 23, which acts on the valve stem 24 of the gas exchange valve 7 via an armature tappet 28, moves between the pole faces of the operating magnets 21 and 22.

A spring housing 29, in which a spring mechanism comprising two valve springs 10 and 11 is accommodated, is provided between the opening magnet 21 and the gas exchange valve 7.

The upper valve spring 10 acts with one end in the valve opening direction 18 on a spring disc 30, which is movable by the gas exchange valve 7, and is supported at the other end by the opening magnet 21. The lower valve spring 11 acts with one end in the closing direction 17 on a spring disc 31, which is moved by the gas exchange valve 7 and is supported at the other end on a spring rest 19.

The illustrations show the actuator 20 in the closed position, in which the closing magnet 22 is energized and the armature 23 bears against the pole face of the closing magnet 22. At the same time, the gas exchange valve 7 is closed by its valve disc 32 resting on a valve-seat ring 33 which is embedded in the cylinder head 25 and forms the opening of a gas exchange channel 34. When the closing magnet 22 is deenergized and the opening magnet 21 is energized, the gas exchange valve 7 opens until the armature 23 bears against the pole face of the opening magnet 21. The maximum opening stroke is achieved thereby.

Variables, which have not been taken into account from the beginning or which change over time, for example, manufacturing tolerances of individual components, wear of the valve-seat, ring 33 etc., can lead to the armature 23 bearing against the pole face of the closing magnet 22 before the valve disc 32 comes to bear against the valve-seat ring 33. as a result of which the gas exchange valve 7 does not close completely. It is also possible that the gas exchange valve 7 closes completely, but the armature 23 does not come to bear against the pole face of the closing magnet 22, or it may lead to play occurring between the valve tappet 28 and the valve stem 24. In order to avoid this, a compensating element 3, which serves as a play-adjusting element, is arranged between the armature tappet 28 and the valve stem 24. The compensating element 3 is supplied with oil under pressure via a cup 35 which is arranged between the compensating element 3 and the armature tappet 28. The cup 35 with its side walls 36 partially surrounds the compensating element 3 and is slidingly supported in a guide 37 which is fixed on the cylinder head. Oil under pressure is supplied to the cup 35.

The cup guide 37 is formed by a separate component 38. The component 38 is inserted in the cylinder head 25 and has a collar 39, which is supported between the opening magnet 21 and a shoulder 40 in the cylinder head 25. The component 38 has, on its outer circumference, a pressure space 41 via which it is in communication, by way of a channel 42, with a pressure connection 43. A channel 44 leads from the pressure space 41 to the guide 37 and to an annular groove 45. Shortly before, and in, the closed position of the gas exchange valve 7, an interior space 46 which is formed between the cup 35 and the compensating element 3 is connected to the annular groove 45 via a channel 47 in the cup 35. The interior space 46 is sealed to the outside via a seal 48 between the compensating element 3 and the cup 35. The armature 23 together with its armature tappet 28, the compensating element 3 and the gas exchange valve 7 can be fitted in a rotationally symmetrical manner. The annular groove 45 ensures that the cup 35 is supplied with oil irrespective of its orientation when installed. When required, the pressure oil is supplied to the compensating element 3 via a recess 49 on an inner top side 67 of the cup 35. The supplying of pressure oil via cups 35 is a technique, which has been perfected and is therefore associated with few problems. However, it is also possible to supply the pressure oil with or without a cup 35 directly to the side of an appropriately designed compensating element or via the armature tappet 28.

By changing the length of the compensating element 3, the overall length of the armature tappet 28, the compensating element 3 and the valve stem 24 can be appropriately adjusted. In an actuator 20, which is mounted in a floating manner, the play-adjusting element, in principle, can also be arranged on that side of the closing magnet 22 which faces away from the gas exchange valve 7 and/or on that side of the opening magnet 21 which faces the gas exchange valve 7.

Certain variables and a resultant play adjustment by the compensating element 3 may result in a position of equilibrium, which is determined by the valve springs 10, 11, which is not coinciding with an energetic center position of the armature between the pole faces or in the armature not having a predetermined position, so that: an improper residual closing force of the lower valve spring 11 is effective, which force acts on the gas exchange valve 7 in the closed position. In order to avoid this, the device has a compensating element 4 with which the spring rest 19 of the valve spring 11, which acts in the closing direction 17, can be displaced. The residual closing force acting in the closing position of the gas exchange valve 7 is constant and can also be set to individual operating states.

Figure 2:
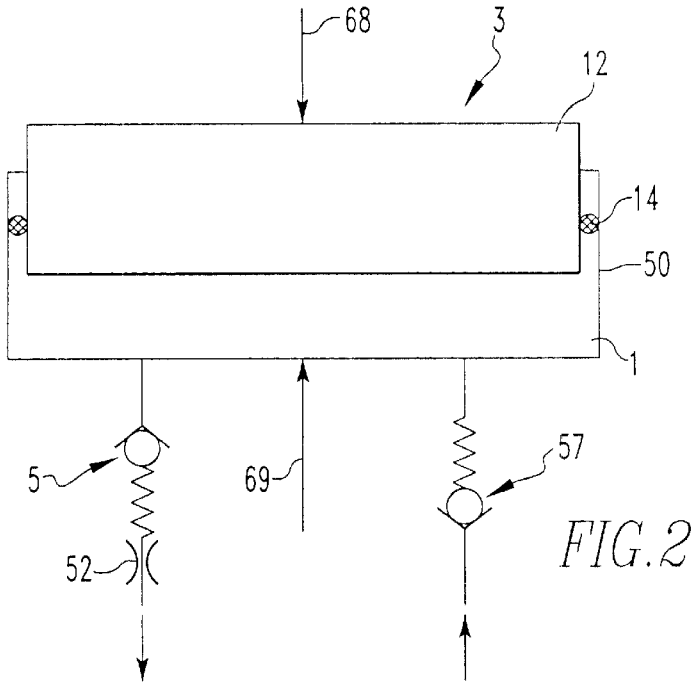
FIG. 2 shows a schematic diagram of a compensating element.

FIG. 2 shows a schematic diagram of the compensating element 3. The compensating element 3 has a pressure space 1, which is formed by a piston 12 and a working cylinder 50 and is sealed to the outside by a seal 14 between the piston 12 and the cylinder 50. The armature tappet 28 acts on the piston 12 with a force 68 in the valve opening direction 18 and the valve stem 24 acts on the cylinder 50 with a force 69 in the closing direction 17.

Figure 4:
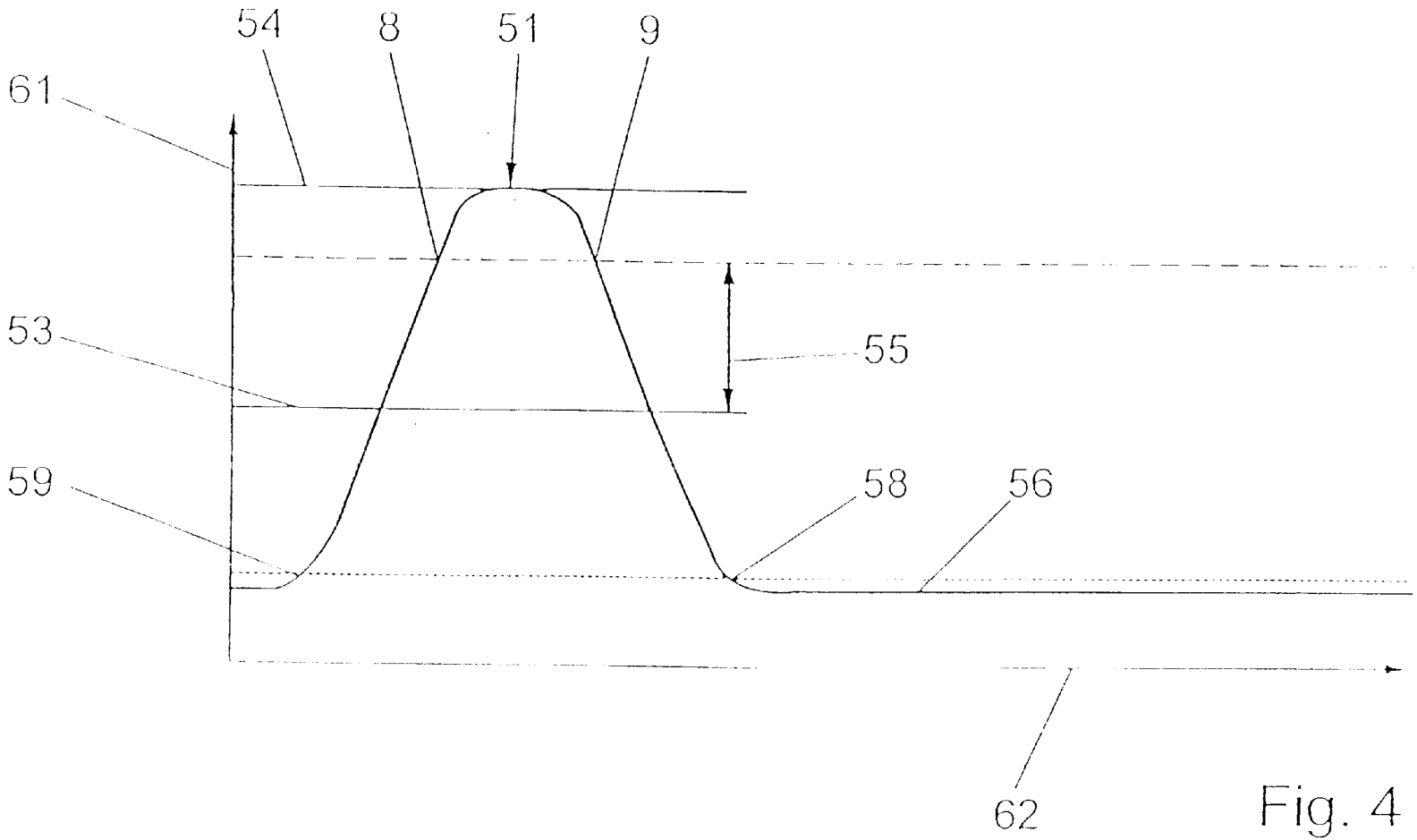
FIG. 4 shows a pressure profile in a pressure space of a compensating element.

In order to open the gas exchange valve 7, the closing magnet 22 is deenergized and the opening magnet 21 is energized, the armature 23 acts on the valve stem 24 in the opening direction 18 and, as it does so, further compresses the valve spring 11, which acts in the closing direction 17. The force acting on the compensating element 3 rises to a maximum value 54. In FIG. 4, a pressure 61 in the pressure space 1 is plotted over a working cycle 62. A valve of the compensating element 3, which valve is designed as a high-pressure valve 5, opens at a defined pressure in the pressure space 1 or at a defined force 8 which is greater by a safety value 55 than an average force 53 and is smaller than a maximum force 54. The high-pressure valve 5, which is preferably designed as a conventional non-return valve, controls the flow through a throttle 52 which can be arranged upstream or downstream of the high-pressure valve 5 in the direction of flow. Therefore, when the valve 5 is open, a small amount of pressure medium can be discharged in a throttled manner without a substantial effect on the pressure profile 51 in the pressure space 1.

In order to close the gas exchange valve 7, the opening magnet 21 is deenergized and the closing magnet 22 is energized. The valve spring 10 which acts in the opening direction 18 is compressed and the valve spring 11 which acts in the closing direction 17 is relaxed. The force acting on the compensating element 3 drops to a minimum value 56, to what is referred to as the residual closing force. The high-pressure valve 5 closes at a defined force 9 which is smaller than the maximum force 54 and is greater by the safety value 55 than the average force 53. Shortly before the residual closing force 56 is reached, a non-return valve 57 opens at a defined force 58 which is smaller than the average force 53. Pressure medium can then be supplied from the pressure connection 43 into the pressure space 1, as a result of which the compensating element 3 expands and positive play can be adjusted. If the gas exchange valve 7 is opened again, the non-return valve 57 closes at a defined force 59 which is greater than the residual valve closing force 56 and smaller than the average force 53. Over a wide range of the opening stroke and closing stroke of the gas exchange valve 7 the high-pressure valve 5 and the non-return valve 57 are tightly closed and the movement of the gas exchange valve 7 is not impaired. During the working cycles of the gas exchange valve 7 a defined fluid release and therefore the possibility of optimum setting are achieved. It is advantageous if the opening force 58 and the closing force 59 of the non-return valve 57 and the opening force 8 and the closing force 9 of the high-pressure valve 5 are the same size. In principle, however, the opening forces may differ in size from the closing forces.

When the actuator 20 is switched off and when the internal combustion engine is shut down, the armature 23 is set to a position of equilibrium of the valve springs 10, 11 between the pole faces of the magnets 21 and 22. The compensating element 3 is acted upon by the average force 53 at which the high-pressure valve 5 and the non-return valve 57 are closed. Pressure medium is not discharged from the pressure space 1 and the setting of the compensating element 3 is maintained.

Figure 3:
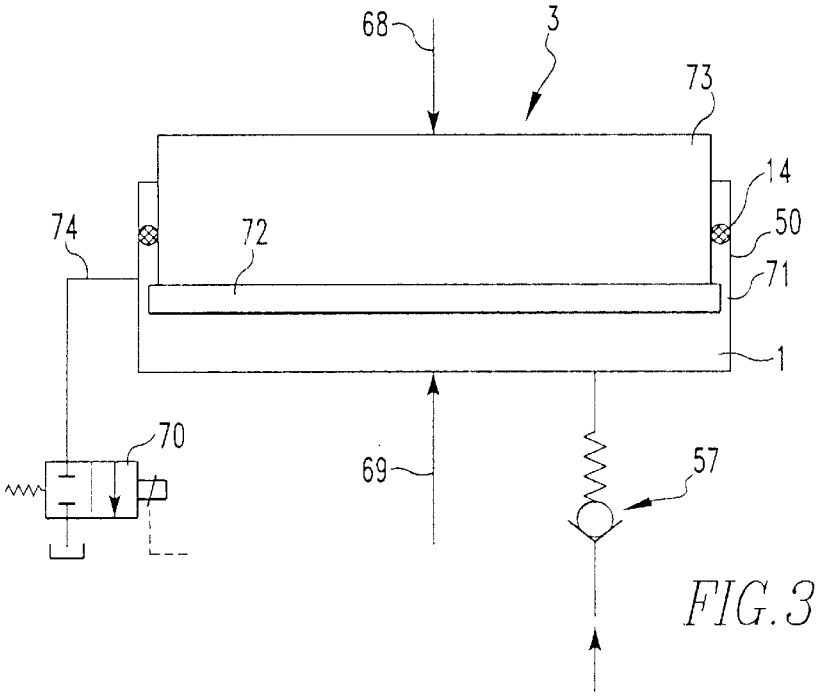
FIG. 3 shows another embodiment of a compensating element according to FIG. 2.

Instead of the high-pressure valve 5, a valve designed as a solenoid valve 70 can be used. FIG. 3 shows a variant having a solenoid valve 70 of this type. In this case, a piston 73 forms by its collar 72 at its circumference a throttle gap 71 towards the working cylinder 50, which throttle gap is sealed to the outside by the seal 14. Between the throttle gap 71 and the seal 14 a return channel 74 is connected which leads to the working cylinder 50. Pressure medium can therefore only be discharged via the throttle gap 71 when the solenoid valve 70 is opened. The pressure medium is conducted into a pressure-medium sump, for example a lubricating-oil sump, or into a supply chamber from which oil is fed to the pressure space 1.

The solenoid valve 70 can be activated as desired as a function of suitable operating parameters, so that the oil discharge via the throttle gap 71 can be restricted in time to certain phases of the operating period. When the solenoid valve 70 is deenergized, the oil discharge from the pressure space 1 is blocked, with the result that the compensating element 3 is locked hydraulically and therefore maintains its setting while the internal combustion engine is at a standstill. The solenoid valve 70 can also be used in a corresponding manner in a compensating element 4 instead of a high-pressure valve 6.

Figure 5:
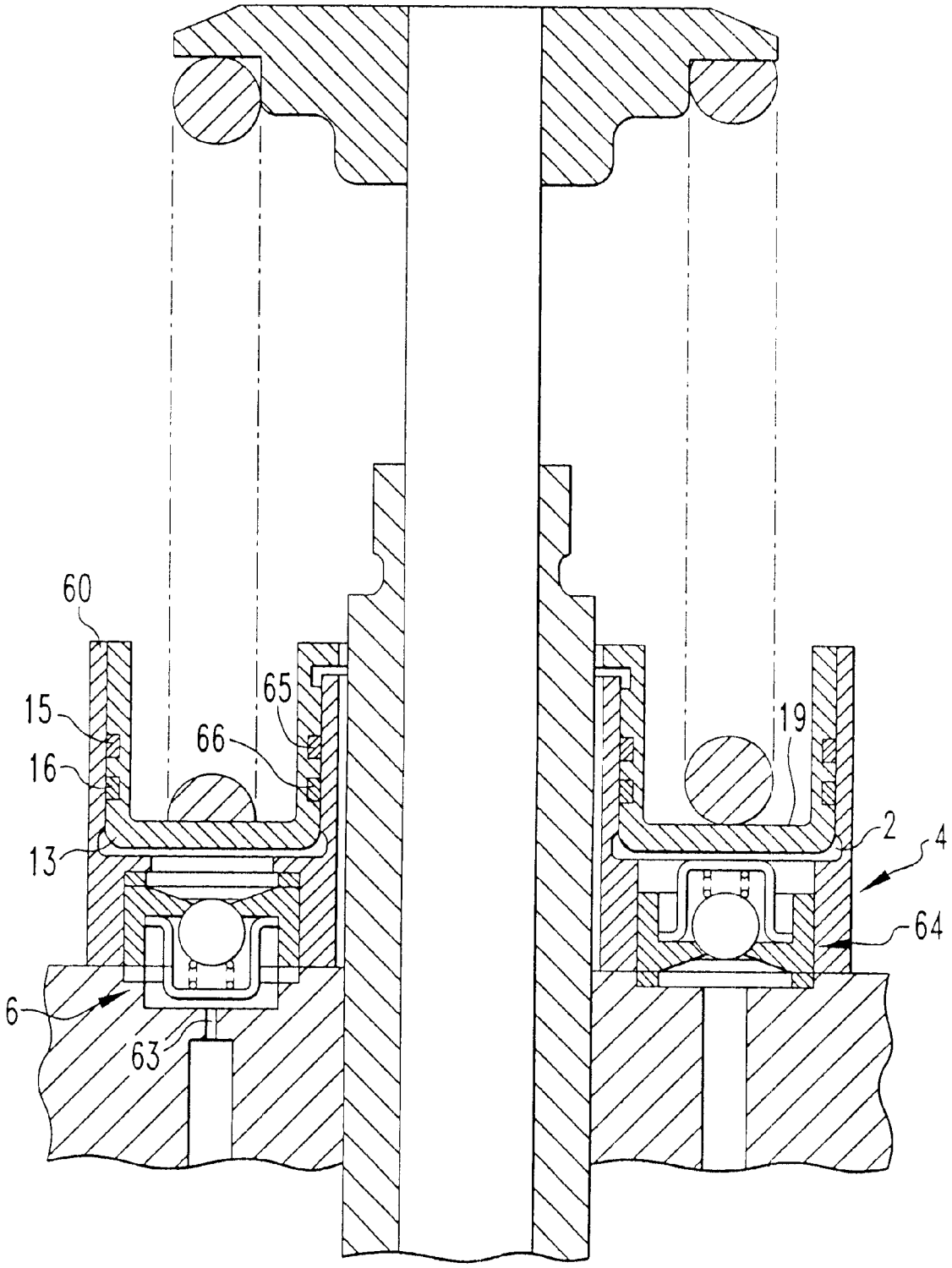
FIG. 5 is an enlarged view of the detail IV circled in FIG. 1.

FIG. 5 shows enlarged details of the compensating element 4 of FIG. 1. The compensating element 4 has a pressure space 2 which is formed by a piston 13 and a working cylinder 60 and is sealed between the piston 13 and the cylinder 60 by four seals 15, 16, 65, 66. Furthermore, the compensating element 4 has a high-pressure valve 6 and a non-return valve 64. The spring rest 19 and the piston 13 are of integral design in order to a save additional components. The spring rest 19 or the piston 13 is U-shaped and, therefore, is easily and readily guided.

The force from the valve spring 11, which force acts on the compensating element 4, fluctuates between a maximum force and a minimum force on the compensating element 3 during the working cycles of the gas exchange valve 7. If the gas exchange valve 7 is opened, the force rises to a maximum value. The high-pressure valve opens at a defined force, which is smaller than the maximum force and is greater, by a safety value, than an average force acting on the compensating element 4. As a result, pressure fluid can be discharged in a throttled manner via the high-pressure valve 6 and via a throttle 63 connected downstream of the high-pressure valve 6. If the gas exchange valve 7 is closed, the force on the compensating element drops to a minimum value. The high-pressure valve 6 closes at a defined force, which is greater by a safety margin than the average force. If the force falls below a defined value, specifically below a predetermined residual closing force, the non-return valve 64 opens. Pressure fluid is discharged again from a pressure connection (not illustrated in detail) into the pressure space 2 until the predetermined residual closing force is set and the non-return valve 64 closes again. As in the case of the compensating element 3, a defined leakage, and therefore the possibility of an optimum setting of the prestress of the valve spring, position of equilibrium and the residual closing force, are achieved during the working cycles of the gas exchange valve 7. When the actuator 20 is out of operation, the high-pressure valve 6 and non-return valve 64 are tightly closed. Pressure fluid is not discharged from the pressure space 2, the setting of the compensating element 4 is maintained and the internal combustion engine can be started again at the setting present at shut down.

What is claimed is:

1. A device for actuating a gas exchange valve of an internal combustion engine, said actuating device including at least one compensating element which has a pressure space formed by a piston and an operating cylinder, said pressure space being connected to a pressure fluid supply via a supply passage including a non-return valve and having a discharge passage with a throttling portion and a control valve for controlling the discharge of pressure fluid from the pressure space, said control valve opening cyclically when a defined force is effective on the compensating element and also closing when a defined force is effective on the compensating element, which force, in each case, is greater than an average force and slightly smaller than, or equal to, a maximum force on the compensating element.

2. A device according to claim 1, wherein said control valve is a solenoid valve, which closes the flow through the throttling portion when the solenoid valve is de-energized.

3. A device according to claim 1, wherein at least one valve spring acts on the gas exchange valve.

4. A device according to claim 1, wherein the pressure space is sealed with respect to the side of the piston by seals disposed between the piston and the cylinder.

5. A device according to claim 1, wherein the control valve is a ball valve acting as a non-return valve.

6. A device according to claim 1, wherein the compensating element is a play-adjusting element.

7. A device according to claim 1, wherein the device has at least one valve spring which, in the closing direction, acts on the gas exchange valve and, in the opening direction, is supported on a spring rest, said spring rest being supported on another compensating element so as to be displaceable together with the compensating element for setting the prestress of the valve spring.

8. A device according to claim 7, wherein the spring rest is of integral design with a piston of the compensating element.

9. A device for actualing a gas exchange valve including an electromagnetic actuator, which has an opening magnet and a closing magnet with pole faces between which an armature is arranged in a manner such that said armature can be displaced axially with respect to the gas exchange valve, said armature acting on a valve stem and having a spring mechanism, which includes a prestressed first valve spring acting on the gas exchange valve in the opening direction and a prestressed second valve spring acting on the valve in the closing direction, one of said prestressed first and second valve springs being supported by a compensating element having a pressure space formed by a piston and an operating cylinder, said pressure space being connected to a pressure fluid supply via a supply passage including a non-return valve and having a discharge passage with a throttling portion and a control valve for controlling the discharge of pressure fluid from the pressure, said control valve opening cyclically when a defined force is effective on the compensating element and closing when a defined force is effective on the compensating element, which force, in each case, is greater than an average force and slightly smaller, or equal to, a maximum force on the compensating element for setting the prestress of said one spring.

* * * * *